US005485770A

United States Patent [19]

Popelak

[11] Patent Number: 5,485,770

[45] Date of Patent: Jan. 23, 1996

[54] PLIER ENGAGING PAD ASSEMBLY

[76] Inventor: Douglas Popelak, 2610 Bonnaffon St., Philadelphia, Pa. 19142

[21] Appl. No.: 408,569

[22] Filed: Mar. 22, 1995

[51] Int. Cl.[6] ..... B25B 7/02

[52] U.S. Cl. ..... 81/423; 81/424.5; 81/426.5

[58] Field of Search ..... 81/423, 424.5, 81/426.5, 185.1, 186

[56] References Cited

U.S. PATENT DOCUMENTS

| | | | |
|---|---|---|---|
| 2,714,321 | 8/1955 | Tamplin | 81/185.1 |
| 3,694,834 | 10/1972 | Daniels, Jr. | 81/426.5 |
| 3,808,870 | 5/1974 | Blancett | 81/423 |
| 3,847,037 | 11/1974 | Fox | 81/424.5 |
| 3,930,329 | 1/1976 | Burkhardt | 81/423 |

FOREIGN PATENT DOCUMENTS

| | | | |
|---|---|---|---|
| 594029 | 10/1947 | United Kingdom | 81/423 |

*Primary Examiner*—Bruce M. Kisliuk
*Assistant Examiner*—Joni B. Danganan

[57] ABSTRACT

A pad assembly for protecting an object being grasped by a pair of pliers. The inventive device includes a first engaging pad securable to a first jaw of a pair of pliers. A second engaging pad is securable to a second jaw of the pliers and cooperates with the first pad during engaging of an object to preclude scratching of the object by the jaws of the pliers.

12 Claims, 3 Drawing Sheets

PLIER ENGAGING PAD ASSEMBLY

BACKGROUND OF THE INVENTION

1. Field of the Invention

The present invention relates to plier tool constructions and more particularly pertains to a plier engaging pad assembly for protecting an object being grasped by a pair of pliers.

2. Description of the Prior Art

The use of plier tool constructions is known in the prior art. More specifically, plier tool constructions heretofore devised and utilized are known to consist basically of familiar, expected and obvious structural configurations, notwithstanding the myriad of designs encompassed by the crowded prior art which have been developed for the fulfillment of countless objectives and requirements.

While the prior art tool constructions fulfill their respective, particular objectives and requirements, the prior art does not disclose a plier engaging pad assembly for protecting an object being grasped by a pair of pliers which includes a first engaging pad securable to a first jaw of a pair of pliers, and a second engaging pad securable to a second jaw of the pliers which cooperates with the first pad during engaging of an object to preclude scratching of the object by the jaws of the pliers.

In these respects, the plier engaging pad assembly according to the present invention substantially departs from the conventional concepts and designs of the prior art, and in so doing provides an apparatus primarily developed for the purpose of protecting an object being grasped by a pair of pliers.

SUMMARY OF THE INVENTION

In view of the foregoing disadvantages inherent in the known types of plier tool constructions now present in the prior art, the present invention provides a new plier engaging pad assembly construction wherein the same can be utilized for protecting an object from being scratched or marred by jaws of a pair of pliers. As such, the general purpose of the present invention, which will be described subsequently in greater detail, is to provide a new plier engaging pad assembly apparatus and method which has many of the advantages of the plier tool constructions mentioned heretofore and many novel features that result in a plier engaging pad assembly which is not anticipated rendered obvious suggested or even implied by any of the prior art plier tool constructions, either alone or in any combination thereof.

To attain this, the present invention generally comprises a pad assembly for protecting an object being grasped by a pair of pliers. The inventive device includes a first engaging pad securable to a first jaw of a pair of pliers. A second engaging pad is securable to a second jaw of the pliers and cooperates with the first pad during engaging of an object to preclude scratching of the object by the jaws of the pliers.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plier engaging pad assembly apparatus and method which has many of the advantages of the plier tool constructions mentioned heretofore and many novel features that result in a plier engaging pad assembly which is not anticipated, rendered obvious, suggested, or even implied by any of the prior art plier tool constructions either alone or in any combination thereof.

It is another object of the present invention to provide a new plier engaging pad assembly which may be easily and efficiently manufactured and marketed.

It is a further object of the present invention to provide a new plier engaging pad assembly which is of a durable and reliable construction.

An even further object of the present invention is to provide a new plier engaging pad assembly which is susceptible of a low cost of manufacture with regard to both materials and labor, and which accordingly is then susceptible of low prices of sale to the consuming public, thereby making such plier engaging pad assemblies economically available to the buying public.

Still yet another object of the present invention is to provide anew plier engaging pad assembly which provides in the apparatuses and methods of the prior art some of the advantages thereof, while simultaneously overcoming some of the disadvantages normally associated therewith.

Still another object of the present invention is to provide a new plier engaging pad assembly for protecting an object being grasped by a pair of pliers.

Yet another object of the present invention is to provide a new plier engaging pad assembly which includes a first engaging pad securable to a first jaw of a pair of pliers, and a second engaging pad securable to a second jaw of the pliers which cooperates with the first pad during engaging go an object to preclude scratching of the object by the jaws of the pliers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
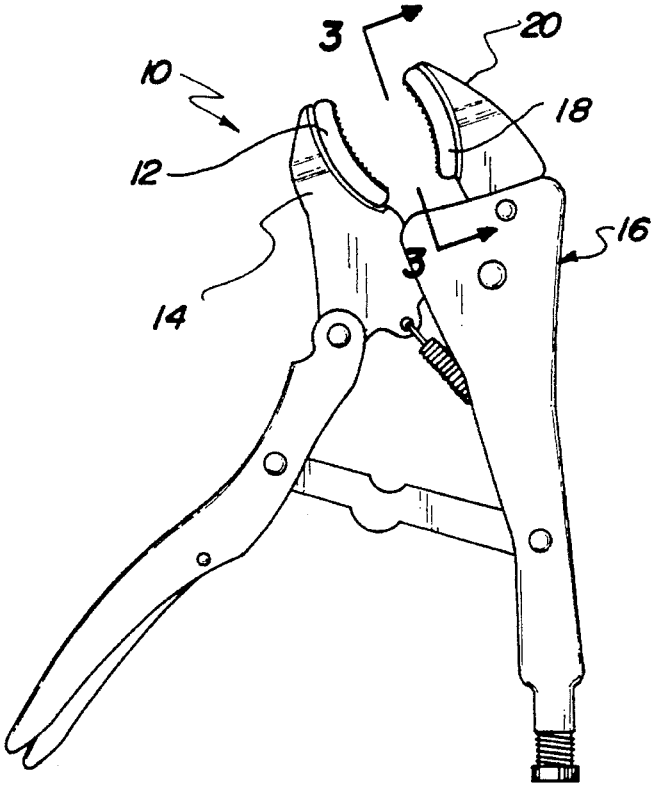
FIG. 1 is an elevation view of a plier engaging pad assembly according to the present invention.

With reference now to the drawings, and in particular to FIGS. 1–6 thereof, a new plier engaging pad assembly embodying the principles and concepts of the present invention and generally designated by the reference numeral will be described.

More specifically, it will be noted that the plier engaging pad assembly 10 comprises a first engaging pad 12 for securing to a first jaw 14 of a pair of locking pliers 16, as shown in FIG. 1 of the drawings. A second engaging pad 18 is securable to a second jaw 20 of the locking pliers 16 and positioned for facing engagement with the first engaging pad 12 during closing of the jaws 14 and 20 during operation of the locking pliers 16. By this structure, an object being grasped between the jaws 14 and 20 of the locking pliers 16 will be protected from scratching or marring of the object by the jaws.

Figure 2:
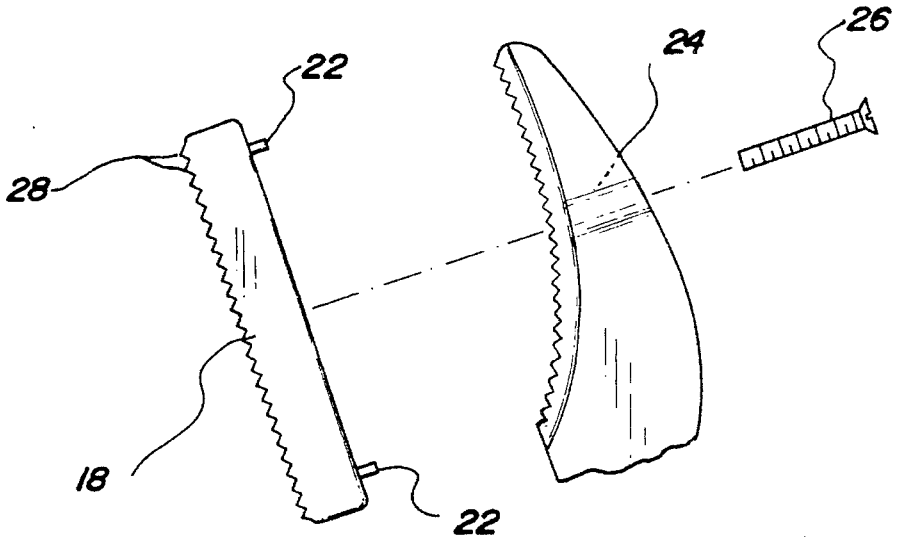
FIG. 2 is an exploded elevation view of a second engaging pad comprising a portion of the present invention.
Figure 3:
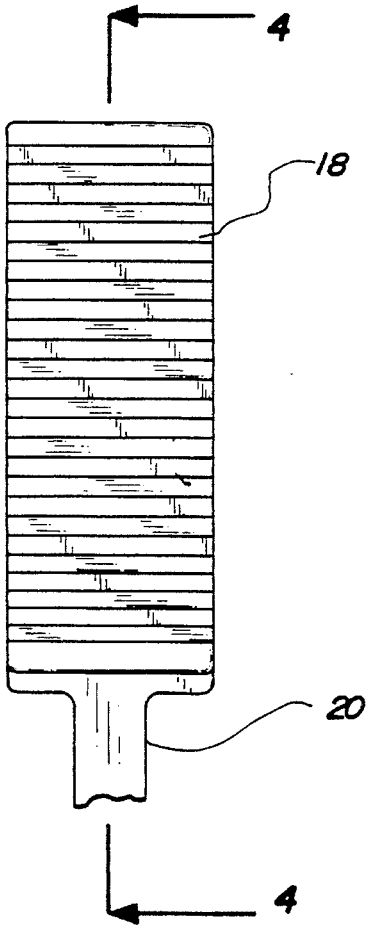
FIG. 3 is an elevation view as seen from line 3—3 of FIG. 1.

As shown in FIG. 2 for the second engaging pad 18, each of the engaging pads 12 and 18 includes a pair of alignment projections 22 extending therefrom which are received within cooperatively configured and positioned unlabeled alignment bores directed into the respective jaws 14 and 20. A mounting aperture 24 is directed through each of the respective jaws 14 and 20 and permits passage of a securing fastener 26 through the jaw for engagement with respective engaging pad 12 and 18 so as to secure the same relative to the respective jaw 14 and 20. Preferably, and as shown in FIGS. 2 and 3, the engaging pads 12 and 18 are each shaped so as to define a plurality of angular gripping projections 28 which cooperate to enhance frictional engagement between the respective engaging pads and an exterior surface of an object being grasped therebetween.

Figure 4:
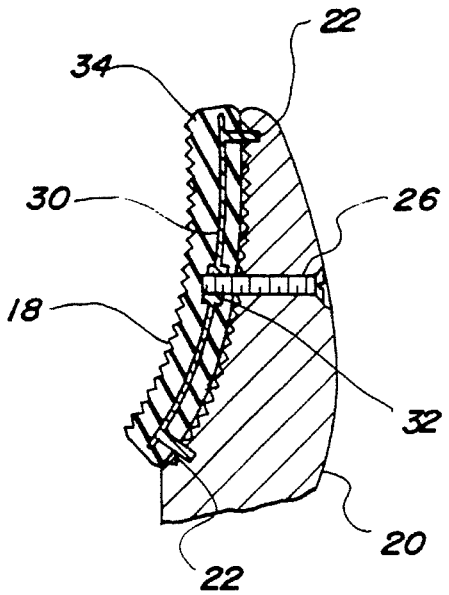
FIG. 4 is a cross sectional view taken along line 4—4 of FIG. 3.

Referring now to FIG. 4 wherein an internal construction of the present invention 10 is illustrated in detail, it can be shown that each of the engaging pads 12 and 18 comprises a flexible interior strip 30 preferably formed of a resilient metal material. The alignment projections 22 project from the flexible interior strip 30 proximal to respectively opposed longitudinal ends thereof. A threaded receiving boss 32 is formed into a center of the flexible interior strip 30 and threadably engages exterior threads of the securing fastener 26 to secure the respective pad 12 or 18 relative to the respective jaw 14 or 20. Each of the engaging pads 12 and 18 is completed by a polymeric casing 34 encapsulating the flexible interior strip 30 from which the alignment projections 22 extend. As described above and shown in FIG. 2, the engaging surface of the polymeric casing 34 can be shaped so as to define a plurality of angular gripping projections 28 which enhance frictional engagement of the respective engaging pad 12 or 18 relative to an exterior surface of an object being grasped therebetween.

Figure 5:
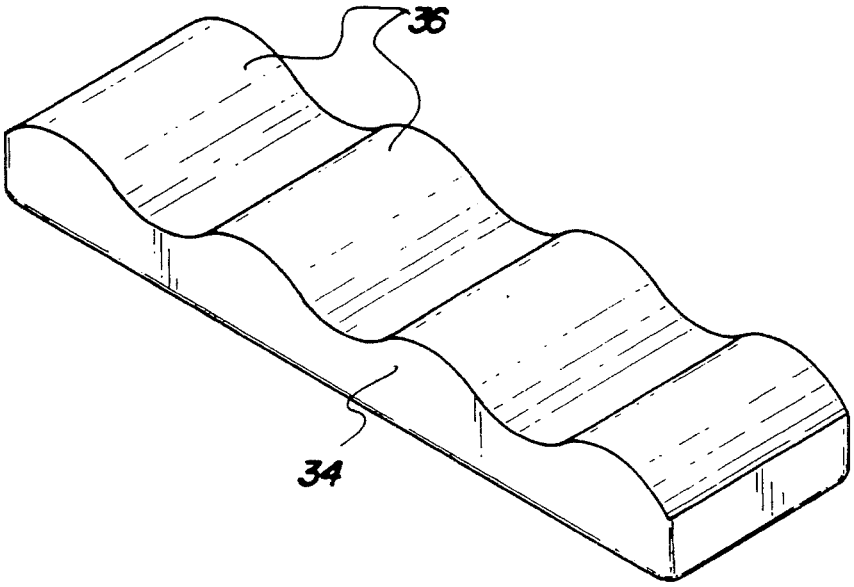
FIG. 5 is an isometric illustration of an alternative form of the engaging pad.
Figure 6:
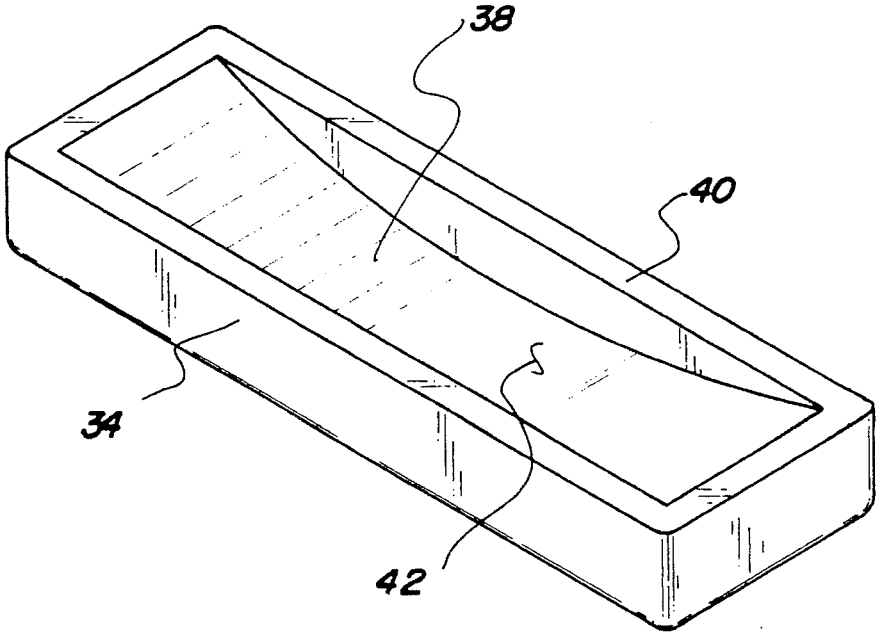
FIG. 6 is an isometric illustration of a further alternative form of the engaging pad.

As shown in FIG. 5, the polymeric casing 34 may alternatively shaped so as to define an undulated engaging surface 36 having a plurality of alternating arcuate projections and arcuate recessions which are substantially sinusoidal in shape. Further, and as shown in FIG. 6, the polymeric casing 34 may be alternatively constructed so as to define a recessed engaging surface 38 having a perimeter side wall 40 extending thereabout which cooperates with the recessed engaging surface so as to define a semi-cylindrical cavity 42 directed into the exterior of the engaging surface of the polymeric casing 34. The alternative form of the polymeric casing 34 of the engaging pad 12 and 18 illustrated in FIG. 6 is particularly useful in grasping round or cylindrical objects such as a tubular collar or the like.

In use, the plier engaging pad assembly 10 according to the present invention can be easily utilized to protect an object being grasped by a pair of locking pliers 16 or other structure including opposed jaws. The various forms of the polymeric casing 34 of each of the engaging pads 12 and 18 permit an individual to select an engaging pad having a desired engaging surface shape for a particular job.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A plier engaging pad assembly comprising:

a first engaging pad for securing to a first jaw of a pair of pliers;

a second engaging pad securable to a second jaw of the pliers for facing engagement with the first engaging pad during closing of the jaws;

wherein the engaging pads each include a pair of alignment projections extending therefrom which can be received within cooperatively configured and positioned alignment bores directed into the respective jaws of the pliers;

wherein each of the pads further comprises a securing fastener threadably engaged thereto which can be extended through a mounting aperture in the respective jaw of the plier to secure the pad thereto;

wherein the engaging pads each comprise a flexible interior strip, with the alignment projections extending from the flexible interior strip proximal to respectively opposed longitudinal ends thereof; a threaded receiving boss positioned in a center of the flexible interior strip and threadably engaging exterior threads of the respective securing fastener; and a polymeric casing encapsulating the flexible interior strip, with the alignment projections extending beyond the polymeric casing.

2. The plier engaging pad assembly of claim 1, wherein an engaging surface of the polymeric casing is shaped so as to define a plurality of angular gripping projections which operate to enhance frictional engagement of the respective engaging pad relative to an exterior surface of an object being grasped.

3. The plier engaging pad assembly of claim 1, wherein an engaging surface of the polymeric casing is shaped so as to define an undulated engaging surface having a plurality of alternating arcuate projections and arcuate recessions which are substantially sinusoidal in shape.

4. The plier engaging pad assembly of claim 1, wherein an engaging surface of the polymeric casing is shaped so as to define a recessed engaging surface having a perimeter side wall extending thereabout which cooperates with the recessed engaging surface so as to define a semi-cylindrical cavity directed into an exterior of the engaging surface of the polymeric casing.

5. A plier engaging pad assembly comprising:

an engaging pad for securing to a first jaw of a pair of pliers;

a securing fastener threadably engaged to the pad which can be extended through a mounting aperture in the first jaw of the pliers to secure the engaging pad thereto;

wherein the engaging pad comprises a flexible interior strip; a threaded receiving boss positioned in a center of the flexible interior strip and threadably engaging exterior threads of the securing fastener; and a polymeric casing encapsulating the flexible interior strip.

6. The plier engaging pad assembly of claim 5, wherein an engaging surface of the polymeric casing is shaped so as to define a plurality of angular gripping projections which operate to enhance frictional engagement of the respective engaging pad relative to an exterior surface of an object being grasped.

7. The plier engaging pad assembly of claim 5, wherein an engaging surface of the polymeric casing is shaped so as to define an undulated engaging surface having a plurality of alternating arcuate projections and arcuate recessions which are substantially sinusoidal in shape.

8. The plier engaging pad assembly of claim 5, wherein an engaging surface of the polymeric casing is shaped so as to define a recessed engaging surface having a perimeter side wall extending thereabout which cooperates with the recessed engaging surface so as to define a semi-cylindrical cavity directed into an exterior of the engaging surface of the polymeric casing.

9. A plier engaging pad assembly comprising:

a pair of pliers having a first jaw and a second jaw;

a first engaging pad secured to the first jaw of the pair of pliers;

a second engaging pad secured to the second jaw of the pliers for facing engagement with the first engaging pad during closing of the jaws;

wherein the engaging pads each include a pair of alignment projections extending therefrom which are received within cooperatively configured and positioned alignment bores directed into the respective jaws of the pliers;

wherein each of the pads further comprises a securing fastener threadably .engaged thereto and extending through a mounting aperture in the respective jaw of the plier to secure the pad thereto;

wherein the engaging pads each comprise a flexible interior strip, with the alignment projections extending from the flexible interior strip proximal to respectively opposed longitudinal ends thereof; a threaded receiving boss positioned in a center of the flexible interior strip and threadably engaging exterior threads of the respective securing fastener; and a polymeric casing encapsulating the flexible interior strip, with the alignment projections extending beyond the polymeric casing.

10. The plier engaging pad assembly of claim 9, wherein an engaging surface of the polymeric casing is shaped so as to define a plurality of angular gripping projections which operate to enhance frictional engagement of the respective engaging pad relative to an exterior surface of an object being grasped.

11. The plier engaging pad assembly of claim 9, wherein an engaging surface of the polymeric casing is shaped so as to define an undulated engaging surface having a plurality of alternating arcuate projections and arcuate recessions which are substantially sinusoidal in shape.

12. The plier engaging pad assembly of claim 9, wherein an engaging surface of the polymeric casing is shaped so as to define a recessed engaging surface having a perimeter side wall extending thereabout which cooperates with the recessed engaging surface so as to define a semi-cylindrical cavity directed into an exterior of the engaging surface of the polymeric casing.

* * * * *